United States Patent [19]

Ohori

[11] Patent Number: 4,788,768

[45] Date of Patent: Dec. 6, 1988

[54] NAIL CLIPPER WITH GUARD MEANS

[76] Inventor: Hiroshi Ohori, 301 Ashley, Brielle, N.J. 08730

[21] Appl. No.: 24,776

[22] Filed: Mar. 11, 1987

[51] Int. Cl.[4] ..... A45D 29/00

[52] U.S. Cl. ..... 30/28; 132/73.5

[58] Field of Search ..... 30/27, 28, 286; 132/76.2, 73.5

[56] References Cited

U.S. PATENT DOCUMENTS

| | | | |
|---|---|---|---|
| 767,423 | 8/1904 | Nicholls | 30/28 X |
| 3,189,996 | 6/1965 | Casey | 30/28 |
| 3,316,634 | 5/1967 | Bliss | 30/28 X |
| 3,943,948 | 3/1976 | Sartore | 30/28 X |
| 4,176,449 | 12/1979 | Lee et al. | 30/28 |

*Primary Examiner*—E. R. Kazenske
*Assistant Examiner*—Michael D. Folkerts
*Attorney, Agent, or Firm*—Kenyon & Kenyon

[57] ABSTRACT

The nail clipper is provided with a guard means formed of two curved members. After pivoting from the protective position, the two curved members can be pivoted relative to each other to form a finger grip for the manipulation of the clipper to cut nails. The two curved members are held on the clipper by a leaf spring.

11 Claims, 1 Drawing Sheet

NAIL CLIPPER WITH GUARD MEANS

This invention relates to a nail clipper having a guard means. More particularly, this invention relates to a nail clipper having a combination guard means and finger grip.

Heretofore, various types of nail clippers have been constructed with guards and with grips. For example, U.S. Pat. Nos. 2,960,766 and 3,316,634 describe nail clippers having guard for protecting against injury from sharp cutting edges. In one case, a guard is rotatable into a position between the usual cutting edges of the nail clipper when not in use. In the other case, a pivotally mounted member is provided for covering over the cutting edges of a clipper.

U.S. Pat. Nos. 3,997,966 and 4,176,449 describe nail clippers with various types of finger grips in order to improve the gripping of the clipper for use. In one case, handles are provided on the components of the nail clipper while in the other case, a conventional nail clipper is incorporated into a clamping bar arrangement.

Generally, the constructions described in the above-noted patents may be adequate to satisfy the limited objects intended. However, none provide a nail clipper of simple construction wherein a user is protected from injury by the sharp cutting edges while also providing a simple means for the handling of the clipper.

Accordingly, it is an object of the invention to reduce the chance of injury caused by the sharp cutting edges of a nail clipper.

It is another object of the invention to enhance the manipulation of a nail clipper.

It is another object of the invention to increase the handleability of a nail clipper.

It is another object of the invention to provide a nail clipper of relatively simple construction which not only guards against injury from sharp cutting edges but also improves the handleability of the clipper.

Briefly, the nail clipper is constructed with a pair of jaws each of which has a clipping edge facing a clipping edge of the other jaw and a guard means which is mounted on one of the jaws in order to move between a first position covering over the cutting edges and a second position spaced from the edges. In addition, the guard means includes a pair of curved members which are pivotally connected to each other for movement between a mating position while covering over the cutting edges and an opposed position to form a finger grip for actuation of the jaws.

The basic construction of the nail clipper is of conventional nature. For example, the jaws are spring biased away from each other while being connected at a remote end by a rivet. A post is provided at the distal end of the jaws and passes through the jaws in rotatably mounted relation.

Also, an operating arm is mounted on one end of the post for rotation with the post while also being pivotally mounted to pivot about an axis transverse to the post. A suitable cam means is provided on the arm for moving the jaws together in response to pivoting of the arm towards one jaw when in a selected operating position.

The guard means is mounted on the clipper on an opposite side from the operating arm. Thus, when the nail clipper is in use, a finger can be inserted into the finger grip while the thumb is pressed against the operating arm. Should the nail clipper then be released, the clipper would be retained on the finger passed through the finger grip.

In order to mount the guard means on the nail clipper, the guard means includes a leaf spring which is secured at one end to a jaw while the opposite end holds one of the curved members in pivotal relation. A suitable stop is also provided on this curved member for abutting the leaf spring when in the open position.

The guard means which is provided on the nail clipper can be made of relatively few parts and may be readily manipulated with one hand. For example, when the nail clipper is in a stored position, the operating arm is substantially flat against one jaw while the guard means covers over the cutting edges. The guard means may then be pivoted away from the cutting edges and one of the curved members may then be rotated into a position to form the grip portion. Thereafter, the operating arm can be manipulated in the usual fashion so as to be positioned for closing the jaws together. With a thumb then on the operating arm, the index finger in the grip portion and the middle finger at the remote end of the clipper, the clipper may be actuated for the cutting or nipping of nails. In the event that the thumb and middle fingers are removed, the clipper would remain on the index finger.

Closing of the clipper into the closed position would be performed in a reverse manner.

In order to enhance the protective position of the guard means over the cutting edges of the clipper, the two curved members are pivotally connected by a rivet which has a head for slidably engaging against the cutting edges of the jaws when in the closed position.

These and other objects and advantages of the invention will become more apparent from the following detailed description taken in conjunction with the accompanying drawings wherein.

Figure 1:
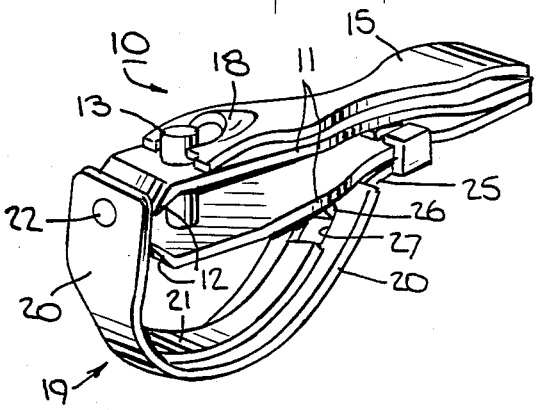
FIG. 1 illustrates a perspective view of a nail clipper constructed in accordance with the invention.
Figure 2:
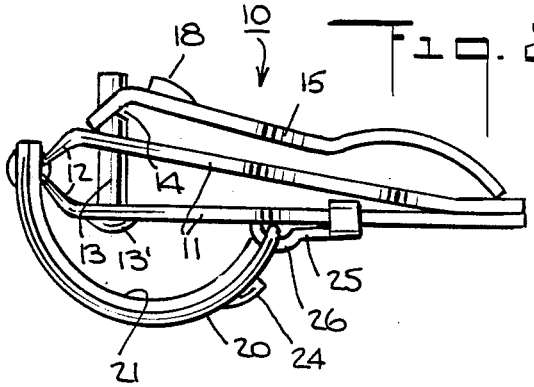
FIG. 2 illustrates a side view of the clipper of FIG. 1 in the closed position.

Referring to FIGS. 1 and 2, the nail clipper 10 has a pair of jaws 11 which are connected together at a remote end for example by means of a rivet or a weld. The jaws 11 are made of conventional materials and shaped so as to be spring biased away from each other in the position illustrated . In addition, each jaw 11 has a sharp clipping edge 12 at the distal end facing the clipped edge 12 of the other jaw 11. As is known, a post 13 having a rivet head 13' passes through suitable apertures near the distal ends of the jaws 11 in a rotatably mounted relation. The post 13 has a notch 14 near the upper end, as viewed, to receive an operating arm 15.

Figure 4:
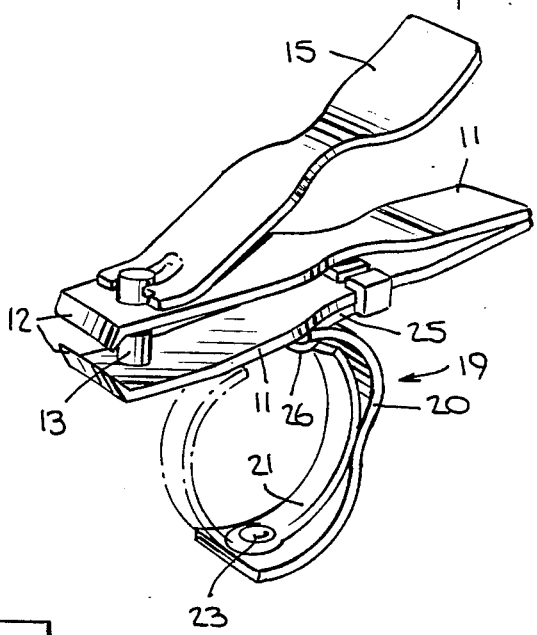
FIG. 4 illustrates an opened position of the clipper of FIG. 1.
Figure 5:
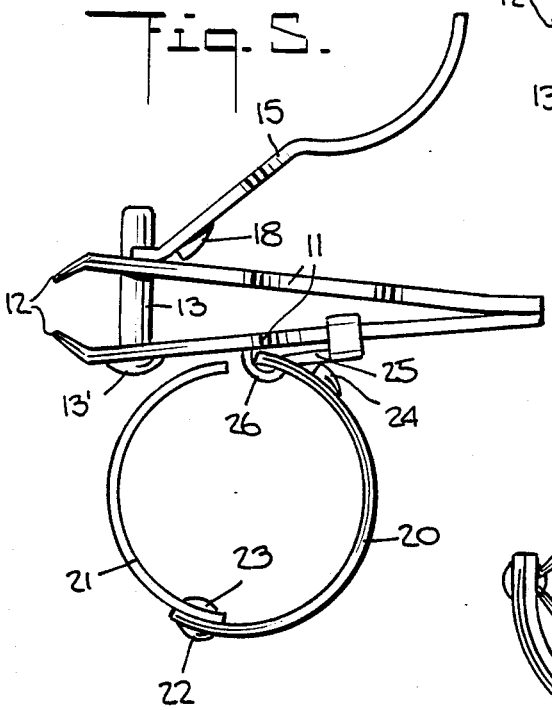
FIG. 5 illustrates a fully opened position of the clipper of FIG. 1 in a position for use.

The operating arm 15 is provided in a conventional manner with a bar-like portion 16 (see FIG. 3) which fits into the notch 14 of the post 13 so as to be pivotally mounted relative to the post 13 while also being retained in place against the upper jaw 11, as viewed. The arm 15 also has an aperture 17 near the pivoted end in order to pass over the post 13 when being pivoted about an axis transverse to the post 13. As indicated in FIGS. 2 and 4, the arm 15 can be rotated with the post 13 and may also be pivoted about the post 13. Further, the arm 15 has a cam means 18 in the form of a raised shoulder which is used to move the jaws 11 together in a conventional manner when the arm 15 is brought from an open position as indicated in FIG. 5 towards the jaws 11.

Figure 3:
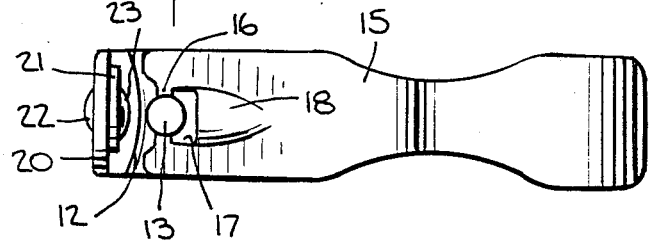
FIG. 3 illustrates a top view of the clipper shown in FIG. 1.

Referring to FIGS. 3 and 4, the jaws 11 and arm 15 are shaped in similar manner with curved sides. The resulting compact curved shape provides anchorage for a plastic sleeve or covering (not shown) to be placed over each of the jaws 11 and arm 15 to enhance contact with the user's fingertips. Also, the use of plastic sleeves or a covering permits advertising media or a name to be printed thereon.

Referring to FIGS. 1 and 2, a guard means 19 is mounted on a side of the clipper 10 opposite the operating arm 15. This guard means 19 is pivotally mounted to move between a first closed position as shown in FIGS. 1 and 2 covering over the cutting edges 12 of the jaws 11 to a second opened position, as shown in FIG. 4, spaced from the cutting edges 12. In addition, the guard means 19 is formed of a pair of curved members 20, 21 which are pivotally connected to each other by means of a rivet 22 for movement between a mating position as shown in FIGS. 1, 2 and 4 and an opposed position as indicated in FIG. 5 to form a finger grip for actuating of the jaws.

As indicated in FIG. 4, the outer curved member 20 may be contoured so as to enhance the shape for gripping by a finger, such as the index finger of a user. In this case, the inner curved member 21 is of small shape and contour and is provided with a free end. The rivet 22 is suitably sized to permit free rotation of the two members 20, 21 relative to each other. Further, the members 20, 21 may be shaped so that the inner member 21 forms a locking fit when pivoted into the closed position illustrated in FIG. 4. To this end, each member 20, 21 may be formed on a different curve from the other.

The rivet 22 which connects the members 20, 21 together, has a head 23 facing the jaws 11 so that when the rivet head 23 is in the position illustrated in FIGS. 1 and 2, the head 23 slidably engages against the cutting edges 12. This serves to retain the guard means 19 in place when the clipper 10 is not in use.

As indicated in FIG. 5, the outer curved member 20 also has a stop 24 which is formed by an integrally projecting portion.

As indicated in FIG. 2, the guard means 19 also includes a leaf spring 25 which is secured at a remote end to the lower jaw 11. To this end, the leaf spring 25 has an elongated portion at the remote end which clamps about a narrowed portion of the jaw 11. In addition, the leaf spring 25 has a curved distal end which forms a hook 26 which passes through an opening 27 (see FIG. 1) in the remote end of the curved member 20 in order to hold the curved members 20, 21 on the lower jaw 11 in pivotal relation.

In order to use the clipper 10, the guard means 19 is pivoted away from the protective position shown in FIG. 1 into the position shown in FIG. 4. Next, the inner curved member 21 is pivoted into the position shown in FIG. 5 so as to form a finger grip of circular shape. A user may then insert an index finger into the finger grip for subsequent manipulation of the clipper.

The operating arm 15 of the clipper is manipulated in conventional fashion so as to first rotate with the post 13 from the position shown in FIG. 1 and thereafter pivoted about a transverse axis through the post 13 into the position shown in FIG. 4.

With the arm 13 in the operating position and the guide means 19 opened to form a finger grip portion as illustrated in FIG. 5, the user may then use the clipper. In this respect, for example, an index finger is inserted through the finger grip formed by the members 20, 21, a thumb is pressed against the free end of the arm 15 and a middle finger is engaged against the jaws 11 on the side of the guard means 19. The arm 15 can then be moved towards the jaw 11 in order to bring the cutting edges 12 together. Since the finger grip permits retention of the clipper on the index finger, the clipper 10 can be moved into different positions for the clipping of nails.

Of note, the clipper 10 may also be used when in the position shown in FIG. 4. In this case, the curved member 20, 21 provide a handle for manipulating the clipper into various positions. For example, the curved members 20, 21 could be held between an index finger and a middle finger of a user.

As illustrated in FIG. 5, the stop 24 on the outer curved member 20 abuts against the leaf spring 25 when the guard is moved into the retracted position. Thus, the stop 24 serves to establish the retracted position for the guard means 19.

The invention thus provides a nail clipper of relatively simple construction which has a guard means which not only serves to protect against injury from the sharp cutting edges of the clipper but also which provides a finger grip for holding the clipper during manipulation.

What is claimed is:

1. A nail clipper comprising
   - a pair of jaws, each said jaw having a clipping edge facing a clipping edge on the other jaw;
   - a post passing through said jaws in rotatably mounted relation;
   - an operating arm mounted on one end of said post for rotation therewith, said arm being pivotally mounted on said post to one side of one jaw to pivot about an axis transverse to said post;
   - cam means on said arm for moving said jaws together in response to pivoting of said arm towards said one jaw in a selected position thereof; and
   - a guard means pivotally mounted on the other jaw to move between a first position covering over said edges of said jaws and a second position spaced from said edges, said guard means including a pair of curved members pivotally connected to each other for movement between a mating position to cover said edges and an opposed position to form a finger grip for actuation of said jaws.

2. A nail clipper as set forth in claim 1 wherein said guard means includes a leaf spring secured at one end to said other jaw and holding one of said curved members on said other jaw at the opposite end in pivotal relation.

3. A nail clipper as set forth in claim 2 wherein said one member has a stop for abutting said leaf spring in said second position.

4. A nail clipper as set forth in claim 1 which further comprises a rivet pivotally connecting said members together and having a head for slidably engaging against said cutting edges in said first position.

5. A nail clipper as set forth in claim 1 wherein one of said members has a stop for abutting said other jaw in said second position.

6. A nail clipper comprising
   - a pair of jaws, each said jaw having a clipping edge facing a clipping edge on the other jaw; and a guard means pivotally mounted on one of said jaws to move between a first position covering over said cutting edges and a second position spaced from said edges, said guard means including a pair of curved members pivotally connected relative to each other for movement between a mating position to cover over said cutting edges and an opposed position to form a finger grip for actuation of said jaws.

7. A nail clipper as set forth in claim 6 wherein said jaws are spring biased away from each other.

8. A nail clipper as set forth in claim 7 further comprising means for moving said jaws together.

9. A nail clipper comprising a pair of jaws, each said jaw having a clipping edge facing a clipping edge on the other jaw; and a guard means mounted on one of said jaws to move between a first position covering over said cutting edges and a second position spaced from said edges, said guard means including a pair of curved members pivotally connected to each other for movement between a mating position to cover over said cutting edges and an opposed position to form a finger grip for actuation of said jaws and a leaf spring secured to said one jaw to hold one of said curved members on said jaw in pivotal relation.

10. A nail clipper as set forth in claim 9 wherein said one member has a stop for abutting said leaf spring in said second position.

11. A nail clipper comprising a pair of jaws, each said jaw having a clipping edge facing a clipping edge on the other jaw; and a guard means mounted on one of said jaws to move between a first position covering over said cutting edges and a second position spaced from said edges, said guard means including a pair of curved members pivotally connected to each other for movement between a mating position to cover over said cutting edges and an opposed position to form a finger grip for actuation of said jaw, and a rivet pivotally connecting said members together and having a head for slidably engaging against said cutting edges in said first position.

* * * * *